US006861831B2

(12) United States Patent
Ngiap Ho

(10) Patent No.: US 6,861,831 B2
(45) Date of Patent: Mar. 1, 2005

(54) VOLTAGE REGULATOR

(75) Inventor: James Choon Ngiap Ho, Singapore (SG)

(73) Assignee: Bluechips Technology PTE Limited, Singapore (SG)

( * ) Notice: Subject to any disclaimer, the term of this patent is extended or adjusted under 35 U.S.C. 154(b) by 0 days.

(21) Appl. No.: 10/464,552

(22) Filed: Jun. 19, 2003

(65) Prior Publication Data

US 2004/0041546 A1 Mar. 4, 2004

(30) Foreign Application Priority Data

Jun. 20, 2002 (SG) ..... 200203749

(51) Int. Cl.[7] ..... G05F 3/16; G05F 3/20
(52) U.S. Cl. ..... 323/315; 323/314; 323/313
(58) Field of Search ..... 323/316, 315, 323/314, 313

(56) References Cited

U.S. PATENT DOCUMENTS 4,792,750 A * 12/1988 Yan ..... 323/315
4,814,688 A * 3/1989 Colles ..... 323/317
5,559,425 A * 9/1996 Allman ..... 323/315
5,783,934 A * 7/1998 Tran ..... 323/312

* cited by examiner

*Primary Examiner*—Bao Q. Vu
(74) *Attorney, Agent, or Firm*—Birch, Stewart, Kolasch & Birch, LLP

(57) ABSTRACT

A voltage regulator (10) is disclosed for producing a regulated voltage at a regulator output (30). The voltage regulator includes a reference voltage generator (12) arranged to provide a reference voltage at a reference output (28). The reference voltage generator includes a plurality of first field effect transistors (18, 20, 22, 24) connected in series, each first field effect transistor (18, 20, 22, 24) being biased so as to operate as a diode, and the reference output (28) being connected to the regulator output (30). The voltage regulator also includes transistor amplifier means (14) arranged to amplify a portion of the reference voltage, and output transistor means (16) connected to said amplified reference voltage portion and to the regulator output (30) such that the output transistor means (16) decreases the regulated voltage when said amplifier reference voltage portion tends to increase, and the output transistor means (16) increases the regulated voltage when said amplified reference voltage portion tends to decrease.

18 Claims, 1 Drawing Sheet

VOLTAGE REGULATOR

This nonprovisional application claims priority under 35 U.S.C. § 119(a) on Patent Application No(s). 200203749-7 filed in SINGAPORE on Jun. 20, 2002, which is(are) herein incorporated by reference.

FIELD OF THE INVENTION

The present invention relates to a voltage regulator and, in particular, to a voltage regulator for use as a CMOS voltage clamp.

BACKGROUND OF THE INVENTION

It is known to provide a voltage regulator which includes a reference voltage source, an operational amplifier, and an output transistor. However, while such a voltage regulator produces a satisfactory regulated voltage output, it is relatively expensive, relatively cumbersome, and as a result not particularly suitable for use as a voltage regulator in VLSI circuits.

It is desirable, therefore, to provide a voltage regulator which produces a satisfactory regulated voltage output but which is relatively simple and inexpensive to manufacture.

SUMMARY OF THE INVENTION

In accordance with a first aspect of the present invention, there is provided a voltage regulator for producing a regulated voltage at a regulator output, the voltage regulator including:

a reference voltage generator arranged to provide a reference voltage at a reference output, the reference voltage generator including a plurality of fist field effect transistors connected in series, each first field effect transistor being biased so as to operate as a diode, and the reference output being connected to the regulator output;

transistor amplifier means arranged to amplify a portion of the reference voltage; and output transistor means connected to said amplified reference voltage portion and to the regulator output such that the output transistor means decreases the regulated voltage when said amplified reference voltage portion tends to increase, and the output transistor means increases the regulated voltage when said amplified reference voltage portion tends to decrease.

In one arrangement, the reference voltage generator further includes a second field effect transistor arranged to operate substantially as a resistor. The second field effect transistor is preferably a MOSFET.

In one arrangement, the transistor amplifier means includes a first transistor inverting amplifier means and a second transistor inverting amplifier means. The first inverting amplifier means may include a third field effect transistor arranged to operate as an amplifier and a fourth field effect transistor arranged to operate substantially as a resistor. The second inverting amplifier means may include a fifth field effect transistor arranged to operate as an amplifier and a sixth field effect transistor arranged to operate substantially as a resistor. Each of the third, fourth, fifth and sixth field effect transistors is preferably a MOSFET.

In one arrangement, the output transistor means includes a seventh field effect transistor having its gate connected so as to receive said amplified reference voltage portion and having its source connected to the regulator output. The seventh field effect transistor is preferably a MOSFET.

In one embodiment, each discrete component of the voltage regulator is a MOSFET.

In accordance with a second aspect of the present invention, there is provided a CMOS circuit including a voltage regulator in accordance with the abovementioned first aspect of the present invention.

BRIEF DESCRIPTION OF THE DRAWING

The present invention will now be described, by way of example only, with reference to the accompanying drawing which is a schematic diagram of a voltage regulator in accordance with an embodiment of the present invention.

DESCRIPTION OF A PREFERRED EMBODIMENT OF THE PRESENT INVENTION

Figure 1:
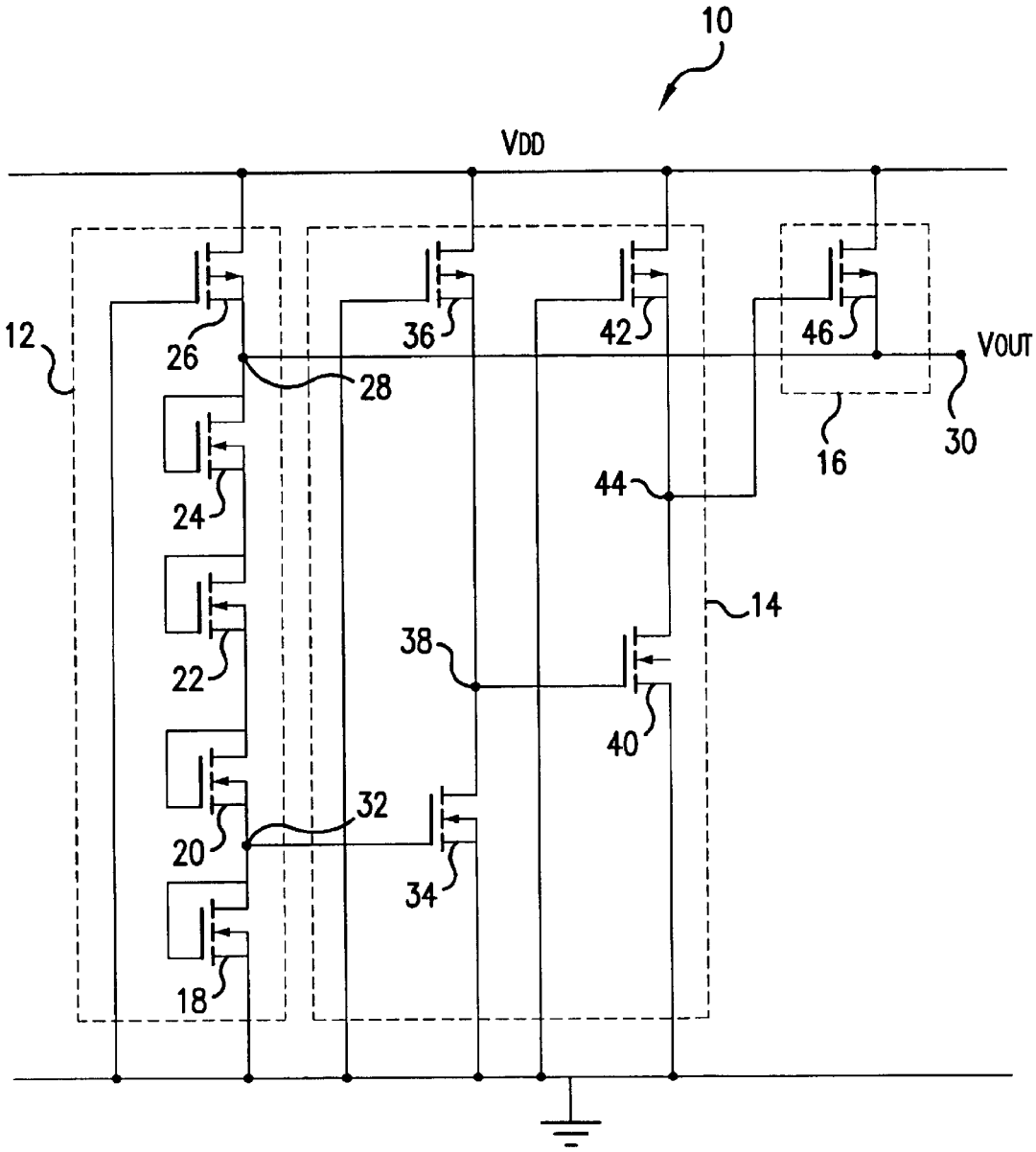

Referring to the drawing, there is shown a voltage regulator 10, in this example constructed entirely of field effect transistors and being particularly suitable for use with a CMOS circuit.

The voltage regulator 10 includes a reference voltage generator 12 arranged to generate a reference voltage, transistor amplifier means 14 for amplifying a portion of the reference voltage generated by the reference voltage generator 12, and output transistor means 16.

The reference voltage generator 12 includes first field effect transistors (FET) 18, 20, 22, 24, in this example n-type metal oxide field effect transistors (MOSFET). The first MOSFETs are connected in series with each other in a 'stack' with each MOSFET having its respective drain and gate terminals connected together. By connecting the drain and gate terminals together, each MOSFET effectively operates as a diode in that a relatively constant voltage is generated across the MOSFET when the current flowing through the MOSFET is above a threshold current.

The reference voltage generator 12 also includes a second FET 26, in this example a p-type MOSFET, connected between the first MOSFETs and the positive supply voltage, the second MOSFET having its gate terminal connected to the negative voltage supply so as to cause the second MOSFET to essentially operate as a resistor. A connection between MOSFET 24 and MOSFET 26 constitutes a reference voltage node 28. A connection between MOSFET 18 and MOSFET 20 constitutes a reference portion node 32.

Since the reference voltage node 28 is connected to a regulator output node 30, the reference voltage at the reference voltage node 28 also constitutes an output voltage.

It will be understood that the magnitude of the reference voltage appearing at the reference voltage node 28 is determined by the number of MOSFETs in the stack and by the aspect ratio of the MOSFETs in the stack.

The transistor amplifier means 14 includes a first transistor inverting amplifier formed by two field effect transistors, in this example an n-type third MOSFET 34 and a p-type fourth MOSFET 36, and a second transistor inverting amplifier formed by two field effect transistors, in this example an n-type fifth MOSFET 40 and a p-type sixth MOSFET 42.

The third MOSFET 34 has its gate connected to the reference portion node 32, its source connected to the negative voltage supply, and its drain connected to the source of the fourth MOSFET 36. The fourth MOSFET 36 has its gate connected to the negative voltage supply and its drain connected to the positive voltage supply so as to cause the fourth MOSFET 36 to essentially operate as a resistor. A connection between the drain of the third MOSFET 34 and the source of the fourth MOSFET 36 constitutes a first inverting amplifier output node 38.

The fifth MOSFET 40 has its gate connected to the first inverting amplifier output node 38, its source connected to the negative voltage supply, and its drain connected to the source of the sixth MOSFET 42. The sixth MOSFET 42 has its gate connected to the negative voltage supply and its drain connected to the positive voltage supply so as to cause the sixth MOSFET 42 to essentially operate as a resistor. A connection between the drain of the fifth MOSFET 40 and the source of the sixth MOSFET 42 constitutes a second inverting amplifier output node 44.

The output transistor means 16 includes a field effect transistor, in this example a p-type seventh MOSFET 46 having its gate connected to the second inverting amplifier output node 44, its drain connected to the positive voltage supply and its source connected to the reference voltage node 28 and the regulator output node 30.

The voltage regulator 10 operates as follows.

When a voltage is applied across the voltage regulator 10, a current flows through the first and second MOSFETs 18, 20, 22, 24, 26 and a reference voltage governed by the number of MOSFETs in the stack and by the aspect ratio of the MOSFETs in the stack appears at the reference voltage node 28. Since the reference voltage node 28 is connected to the regulator output node 30, the reference voltage also appears at the regulator output node 30 as the output voltage.

Although the first MOSFETs 18, 20, 22, 24 are configured so as to operate as diodes, if the positive supply voltage increases, the reference voltage at the reference voltage node 28 and thereby at the regulator output node 30 will tend to increase slightly. This, in turn, causes a slight increase in the reference voltage portion at the reference portion node 32.

The reference voltage portion appearing at the reference portion node 28 is amplified by the first inverting amplifier such that the increase in the reference voltage portion results in a decrease in voltage at the first inverting amplifier output node 38. The voltage at the first inverting amplifier output node 38 is amplified by the second inverting amplifier such that a decrease in the voltage at the first inverting amplifier output node 38 results in an increase in the voltage at the second inverting amplifier output node 44.

It will also be understood that although the voltage at the regulator output node 30 tends to increase with increasing supply voltage, the voltage at the second inverting amplifier output node 44 also tends to increase, and will increase by an order of magnitude which is greater than the order of magnitude by which the reference voltage increases. As a consequence, the magnitude of the voltage across the gate-source junction of the seventh MOSFET 46 will reduce with increasing supply voltage, and the output voltage at the regulator output node 30 will decrease.

Similarly, when the supply voltage decreases, the voltages at the reference voltage node 28, at the regulator output node 30 and at the reference portion node 32 will tend to decrease slightly. As a result, the voltage at the first inverting amplifier output node 38 will increase and the voltage at the second inverting amplifier output node 44 will decrease. This causes the magnitude of the voltage across the gate-source junction of the seventh MOSFET 46 to increase and the output voltage at the regulator output node 30 to increase.

When the supply voltage drops significantly such that the supply voltage is less than the desired reference voltage, the voltage at the reference portion node 32 tends to decrease significantly. This causes the voltage at the second inverting amplifier output node 44 to also decrease significantly and the magnitude of the voltage across the gate-source junction of the seventh MOSFET 46 to increase significantly. As a result, the seventh MOSFET 46 is caused to operate as a switch and the supply voltage appears at the regulator output node 30.

It will be understood that since the reference voltage and thereby the output voltage is governed by the number of MOSFETs in the stack and by the aspect ratio of the MOSFETs in the stack, the desired regulated voltage can be obtained relatively easily by selecting an appropriate number of MOSFETs in the stack or by selecting MOSFETs of an appropriate aspect ratio.

Modifications and variations as would be apparent to a skilled addressee are deemed to be within the scope of the present invention.

What is claimed is:

1. A voltage regulator for producing a regulated voltage at a regulator output, the voltage regulator including:

a reference voltage generator arranged to provide a reference voltage at a reference output, the reference voltage generator including a plurality of first field effect transistors connected in series, each first field effect transistor being biased so as to operate as a diode, and the reference output being connected to the regulator output;

transistor amplifier means arranged to amplify a portion of the reference voltage; and output transistor means connected to said amplified reference voltage portion and to the regulator output such that the output transistor means decreases the regulated voltage when said amplifier reference voltage portion tends to increase, and the output transistor means increases the regulated voltage when said amplified reference voltage portion tends to decrease, wherein a portion of the reference voltage at a node between two of the plurality of first field effect transistors serves as an input to the transistor amplifier means, and wherein the output transistor means includes a seventh field effect transistor, a gate of said seventh transistor being connected so as to receive said amplified reference voltage portion, and a source of said seventh transistor being connected to the regulator output.

2. The voltage regulator as claimed in claim 1, wherein the reference voltage generator further includes a second field effect transistor arranged to operate substantially as a resistor.

3. The voltage regulator as claimed in claim 2, wherein the second field effect transistor is a MOSFET.

4. The voltage regulator as claimed in claim 1, wherein the transistor amplifier means includes a first transistor inverting amplifier means and a second transistor inverting amplifier means.

5. The voltage regulator as claimed in claim 4, wherein the first inverting amplifier means includes a third field effect transistor arranged to operate as an amplifier and a fourth field effect transistor arranged to operate substantially as a resistor.

6. The voltage regulator as claimed in claim 5, wherein the second inverting amplifier means includes a fifth field effect transistor arranged to operate as an amplifier and a sixth field effect transistor arranged to operate substantially as a resistor.

7. The voltage regulator as claimed in claim 6, wherein each of the third, fourth, fifth and sixth field effect transistors is a MOSFET.

8. The voltage regulator as claimed claim 1, wherein the seventh field effect transistor is a MOSFET.

9. The voltage regulator as claimed in claim 6, wherein each of the transistors of the voltage regulator is a MOSFET.

10. A voltage regulator for producing a regulated voltage at a regulator output, the voltage regulator including:

a reference voltage generator arranged to provide a reference voltage at a reference output, the reference voltage generator including a plurality of first field effect transistors connected in series, each first field effect transistor being biased so as to operate as a diode, and the reference output being connected to the regulator output;

transistor amplifier means arranged to amplify a portion of the reference voltage; and output transistor means connected to said amplified reference voltage portion and to the regulator output such that the output transistor means decreases the regulated voltage when said amplifier reference voltage portion tends to increase, and the output transistor means increases the regulated voltage when said amplified reference voltage portion tends to decrease, wherein the reference voltage generator and transistor amplifier means and the output transistor means are each directly connected to a positive supply voltage of the voltage regulator.

11. The voltage regulator as claimed in claim 10, wherein the reference voltage generator further includes a second field effect transistor arranged to operate substantially as a resistor.

12. The voltage regulator as claimed in claim 11, wherein the second field effect transistor is a MOSFET.

13. The voltage regulator as claimed in claim 10, wherein the transistor amplifier means includes a first transistor inverting amplifier means and a second transistor inverting amplifier means.

14. The voltage regulator as claimed in claim 13, wherein the first inverting amplifier means includes a third field effect transistor arranged to operate as an amplifier and a fourth field effect transistor arranged to operate substantially as a resistor.

15. The voltage regulator as claimed in claim 14, wherein the second inverting amplifier means includes a fifth field effect transistor arranged to operate as an amplifier and a sixth field effect transistor arranged to operate substantially as a resistor.

16. The voltage regulator as claimed in claim 15, wherein each of the third, fourth, fifth and sixth field effect transistors is a MOSFET.

17. The voltage regulator as claimed in claim 15, wherein the output transistor means includes a seventh field effect transistor, a gate of said seventh transistor being connected so as to receive said amplified reference voltage portion and a source of said seventh transistor being connected to the regulator output.

18. The voltage regulator as claimed in claim 17, wherein the seventh field effect transistor is a MOSFET.

* * * * *